US009238528B2

(12) United States Patent
Fang

(10) Patent No.: US 9,238,528 B2
(45) Date of Patent: Jan. 19, 2016

(54) DUAL-CUP ASSEMBLY

(71) Applicant: Yu Fang, Tainan (TW)

(72) Inventor: Yu Fang, Tainan (TW)

( * ) Notice: Subject to any disclaimer, the term of this patent is extended or adjusted under 35 U.S.C. 154(b) by 0 days.

(21) Appl. No.: 14/330,080

(22) Filed: Jul. 14, 2014

(65) Prior Publication Data

US 2015/0069073 A1 Mar. 12, 2015

(30) Foreign Application Priority Data

Sep. 6, 2013 (TW) ..... 102216792 U

(51) Int. Cl.

| | |
|---|---|
| ***B65D 81/38*** | (2006.01) |
| ***B65D 41/08*** | (2006.01) |
| ***B65D 51/00*** | (2006.01) |
| ***A47G 19/22*** | (2006.01) |

(52) U.S. Cl.

CPC ..... *B65D 41/08* (2013.01); *A47G 19/2288* (2013.01); *B65D 51/00* (2013.01); *B65D 81/3869* (2013.01); *B65D 81/3874* (2013.01)

(58) Field of Classification Search

CPC ..... B65D 41/26; B65D 41/08; B65D 51/14; B65D 51/00; B65D 51/145; F16B 21/18

USPC ..... 220/23.87, 592.27; 215/274, 275; 70/164, 18

See application file for complete search history.

(56) References Cited

U.S. PATENT DOCUMENTS

| | | | | | |
|---|---|---|---|---|---|
| 256,079 | A | * | 4/1882 | Trackwell | 70/18 |
| 3,193,129 | A | * | 7/1965 | Pfluger et al. | 220/4.16 |
| 4,300,373 | A | * | 11/1981 | Camos et al. | 70/232 |
| 4,329,860 | A | * | 5/1982 | Moberg | 70/164 |
| 4,566,509 | A | * | 1/1986 | Szajna | 141/381 |
| 5,137,162 | A | * | 8/1992 | Fritz | 215/40 |
| 7,868,845 | B2 | * | 1/2011 | Gratton et al. | 348/878 |

FOREIGN PATENT DOCUMENTS

| | | |
|---|---|---|
| TW | M339276 | 9/2008 |

* cited by examiner

*Primary Examiner* — Andrew Perreault
(74) *Attorney, Agent, or Firm* — Rosenberg, Klein & Lee

(57) ABSTRACT

A dual-cup assembly includes an inner cup and an outer cup in which the inner cup is inserted. Each of the inner and outer cups has flange extending from the outside thereof. A fastening unit is mounted to the two respective flanges to connect the inner cup and the outer cup together. A room is defined between the inner cup and the outer cup.

2 Claims, 7 Drawing Sheets

DUAL-CUP ASSEMBLY

BACKGROUND OF THE INVENTION

1. Fields of the Invention

The present invention relates to a dual-cup assembly, and more particularly, to a dual-cup assembly that is easily assembled and has an inner cup and an outer cup.

2. Descriptions of Related Art

The conventional dual-cup assembly generally is composed of an inner cup and an outer cup in which the inner cup is received, and a space is defined between the inner and outer cups. The space is made to be a vacuum space so as to isolate air from being in contact with the inner cup so that the temperature of the liquid in the inner cup can be maintained for a longer period of time. The vacuum space does not have air received therein and the heat of the liquid is then kept in the inner cup.

A conventional dual-cup assembly is disclosed in Taiwan Utility Model M339276 and has a jar with an opening. A first connection portion is formed at the opening. The jar has an outer portion and an inner portion, and a space is formed between the inner and outer portions. A cap has a second connection portion to be connected with the first connection portion to seal the opening.

The space is made to be a vacuum space, and the inner portion and the outer portion are connected to each other by a special method. These requirements make the dual-cup assembly be expensive. Besides, the inner portion cannot have replaceable patterns to provide visual characters.

The present invention intends to provide a dual-cup assembly to eliminate the shortcomings mentioned above.

SUMMARY OF THE INVENTION

The present invention relates to a dual-cup assembly and comprises an inner cup, an outer cup and a fastening unit. The inner cup has a space defined therein and a first flange extends from the outside of the inner cup. The outer cup has a reception room in which the inner cup is received. A second flange extends from the outside of the outer cup. The fastening unit is mounted to the first flange and the second flange to connect the inner cup and the outer cup together.

Preferably, a seal ring is located between the first and second flanges.

Preferably, the fastening unit comprises a first member, a second member and a restriction member. The second member is pivotably connected to the first member. Each of the first member and the second member has a groove defined in the inner periphery thereof. The first and second flanges are received in the two respective grooves. Each of the first and second members has a tongue extending from the distal end thereof. The restriction member has a passage in which the two tongues are inserted.

Preferably, the first and second members are formed integrally to each other.

Preferably, the first and second members are pivotably connected to each other by a connection member.

Preferably, the two respective grooves of the first and second members are C-shaped.

Preferably, the passage is defined in the top of the restriction member. The two tongues are inserted into the passage and the restriction member is used as a handle.

Preferably, the passage is defined in one of the sides of the restriction member. The two tongues are inserted into the passage and the restriction member is used as a handle.

The primary object of the present invention is to provide a dual-cup assembly which is easily manufactured and has satisfied sealing feature.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
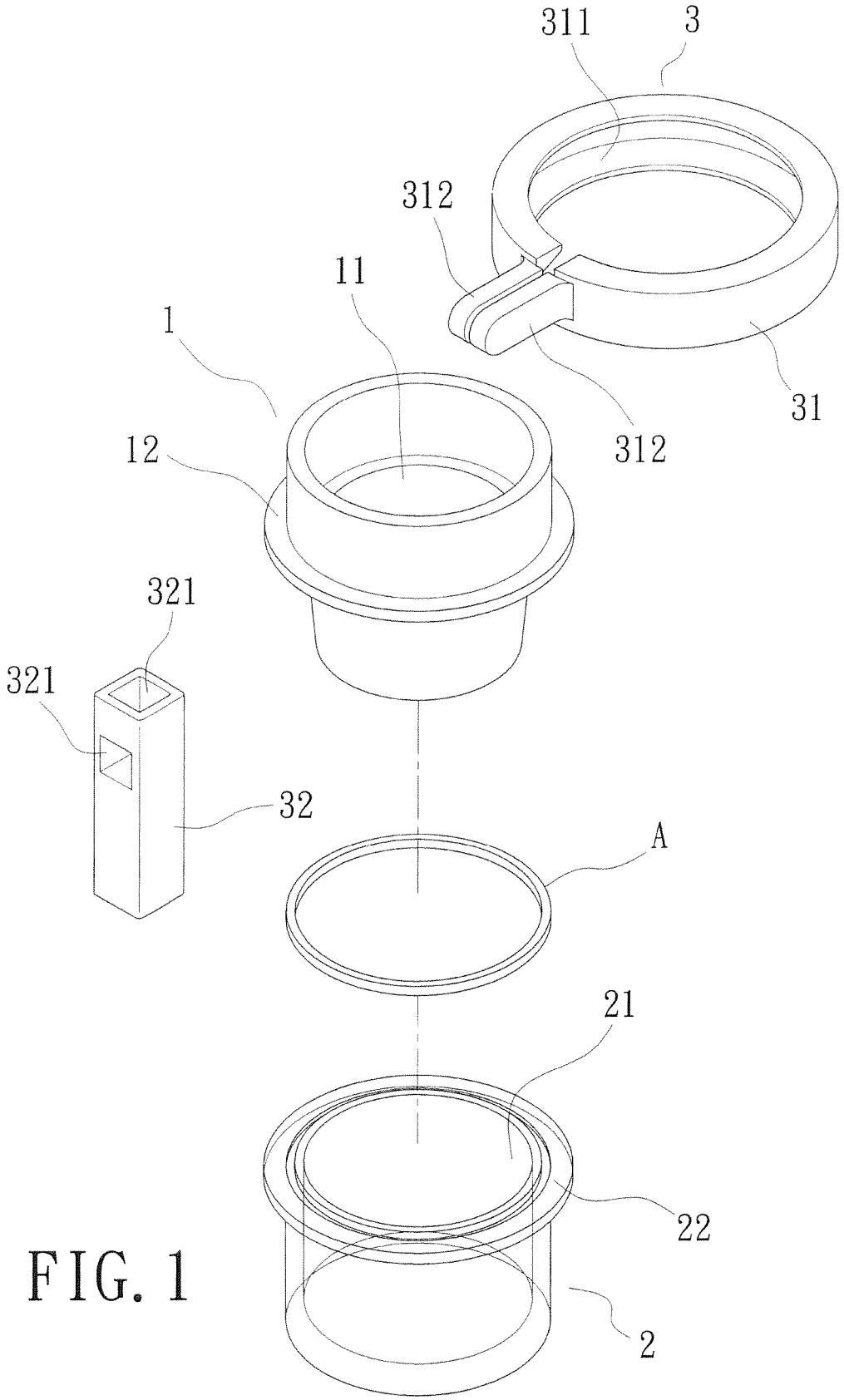
FIG. 1 is an exploded view of the dual-cup assembly of the present invention.
Figure 2:
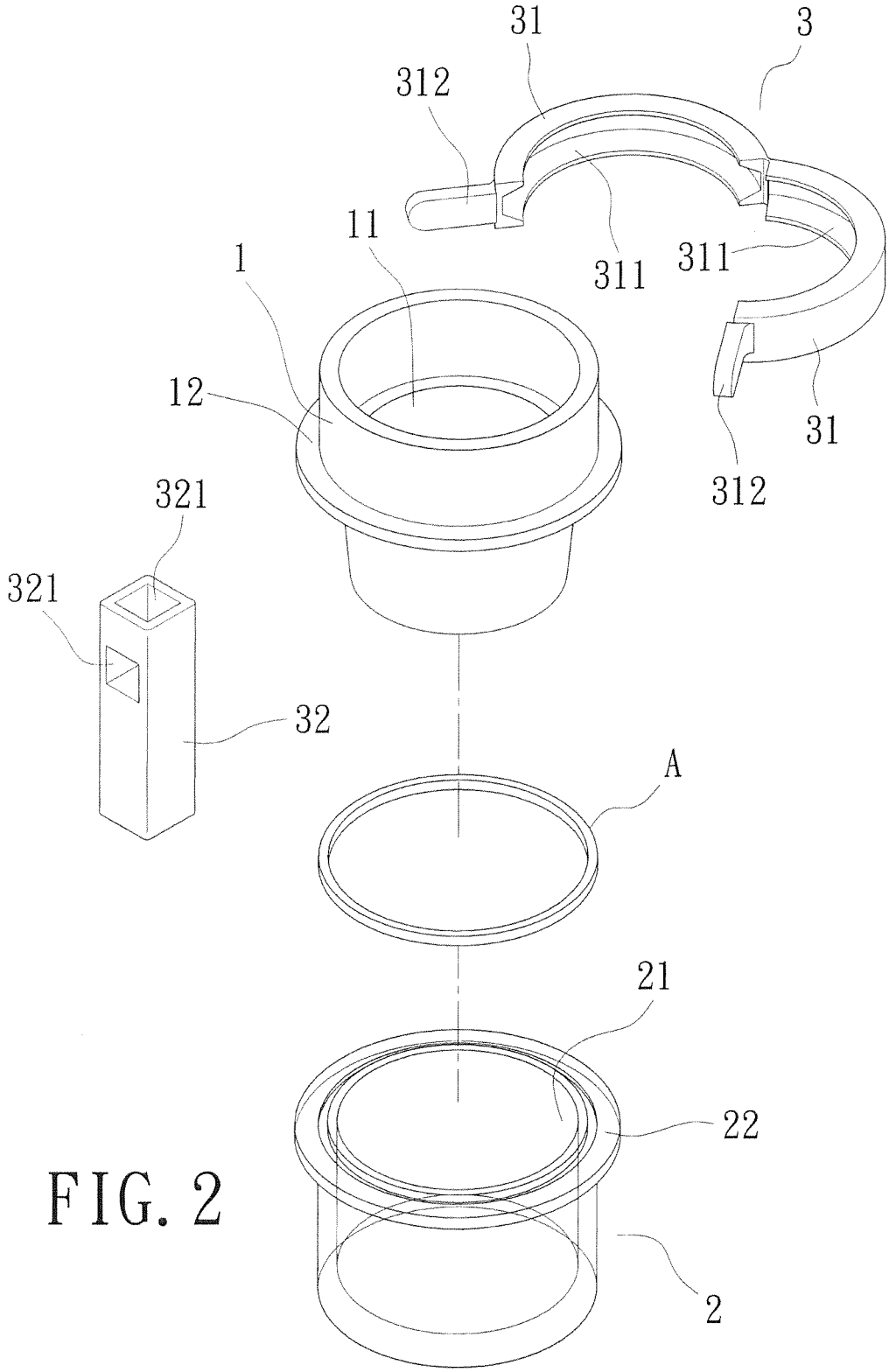
FIG. 2 is an exploded view of the second embodiment of the dual-cup assembly of the present invention.

Referring to FIGS. 1 to 2, the dual-cup assembly of the present invention comprises an inner cup 1 having a space 11 defined therein, and a first flange 12 extends from the outside of the inner cup 1. An outer cup 2 has a reception room 21 in which the inner cup 1 is received. A second flange 22 extends from the outside of the outer cup 2. A fastening unit 3 is mounted to the first flange 12 and the second flange 22 to connect the inner cup 1 and the outer cup 2 together.

The fastening unit 3 comprises a C-shaped member 31 and a restriction member 32. The C-shaped member 31 has a groove 311 defined in the inner periphery thereof. The first and second flanges 12, 22 are received in the groove 311. Two tongues 312 respectively extend from two distal ends of the C-shaped member 31. The restriction member 32 has a passage 321 in which the two tongues 312 are inserted.

As shown in FIG. 2, the fastening unit 3 comprises a first member 31, a second member 31 and a restriction member 32. The second member 31 is pivotably connected to the first member 31. Each of the first member 31 and the second member 31 has a groove 311 defined in the inner periphery thereof. The first and second flanges 12, 22 are received in the two respective grooves 311. Each of the first and second members 31 has a tongue 312 extending from the distal end thereof. The restriction member 32 has a passage 321 in which the two tongues 312 are inserted.

Figure 3:
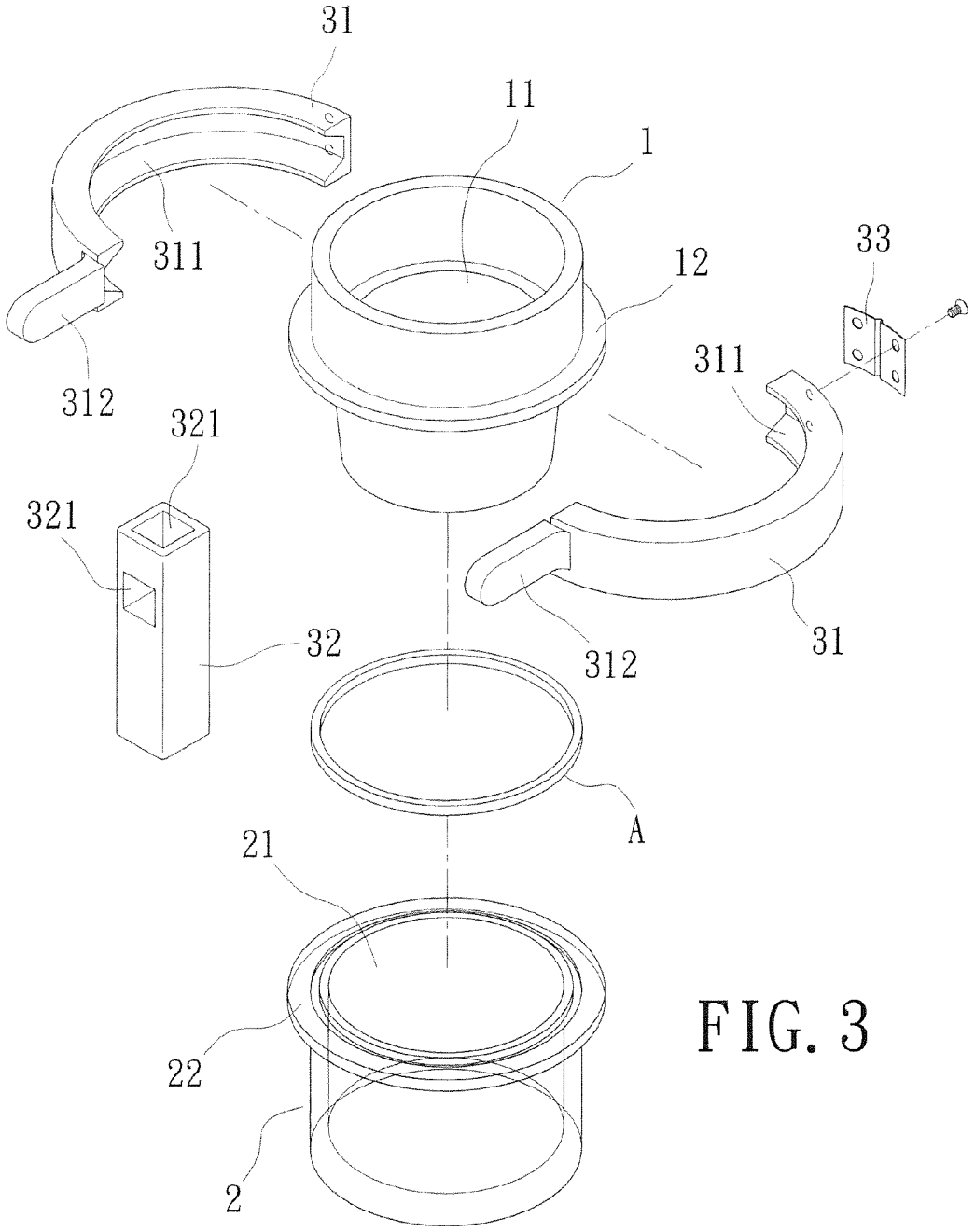
FIG. 3 is an exploded view of the third embodiment of the dual-cup assembly of the present invention.
Figure 4:
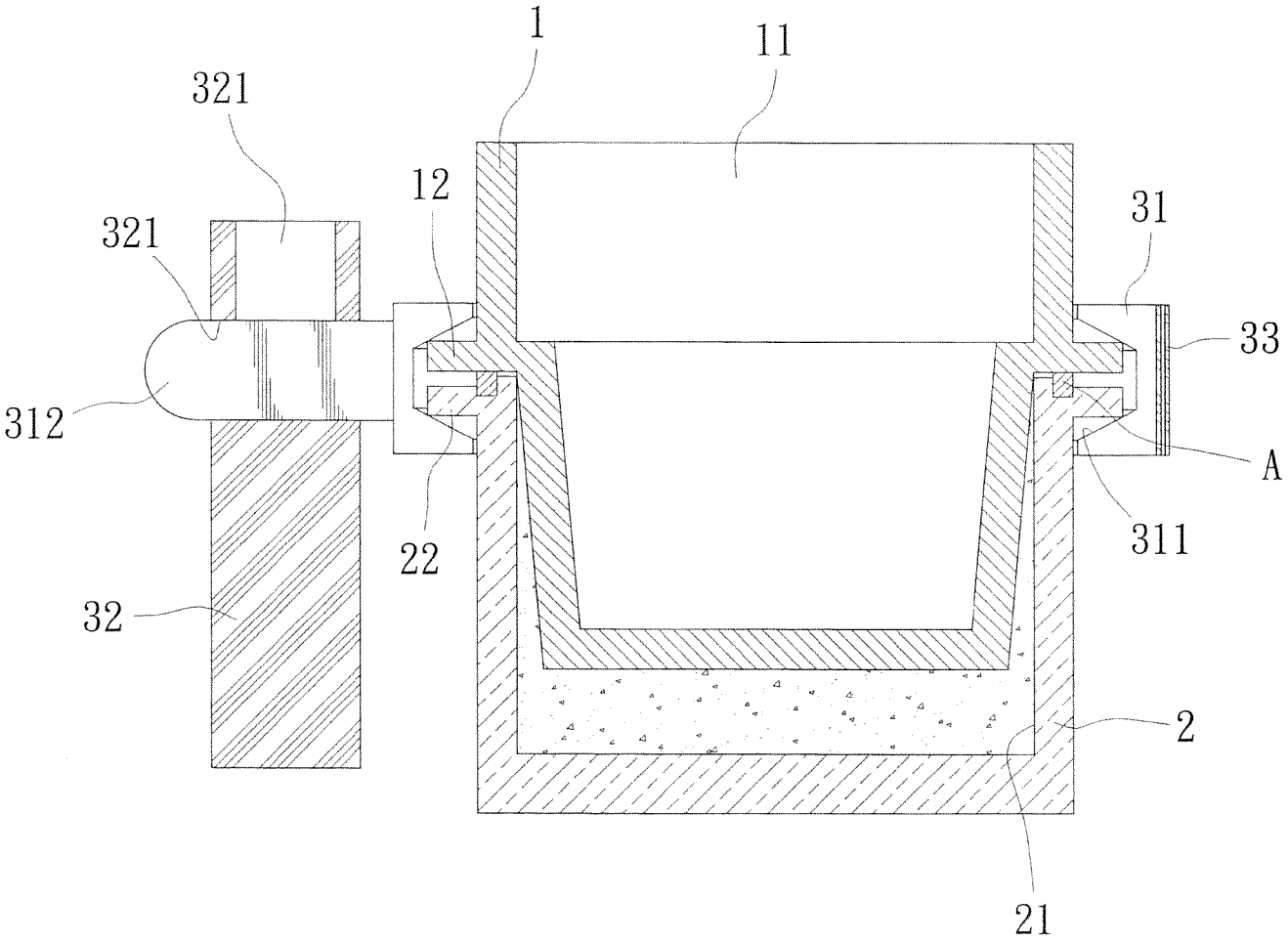
FIG. 4 is a cross sectional view of the dual-cup assembly of the present invention.

As shown in FIGS. 1 to 7, the inner cup 1 is inserted into the outer cup 2, and the reception room 21 is larger than the inner cup 1 so as to form a room between the inner and outer cups 1, 2. Isolation material or colorful material is received in the room between the inner and outer cups 1, 2. The first flange 12 is located above the second flange 22, and a seal ring "A" is located between the first and second flanges 12, 22 to provide a sealed feature. The first and second flanges 12, 22 are received in the groove 311 of the integrally formed C-shaped member 31. The C-shaped member 31 is made of flexible material. Alternatively, the first and second flanges 12, 22 are received in the two respective grooves 311 of the first and second members 31. The two tongues 312 are inserted into the passage 321 of the restriction member 32 to secure the first and second members 31, 31. As shown in FIG. 3, the first and second members 31 are pivotably connected to each other by a connection member 33 which is a hinge, so that the first and second members 31 can be opened from each other or connected to each other. The two respective grooves 311 of the first and second members 31 are C-shaped.

Figure 5:
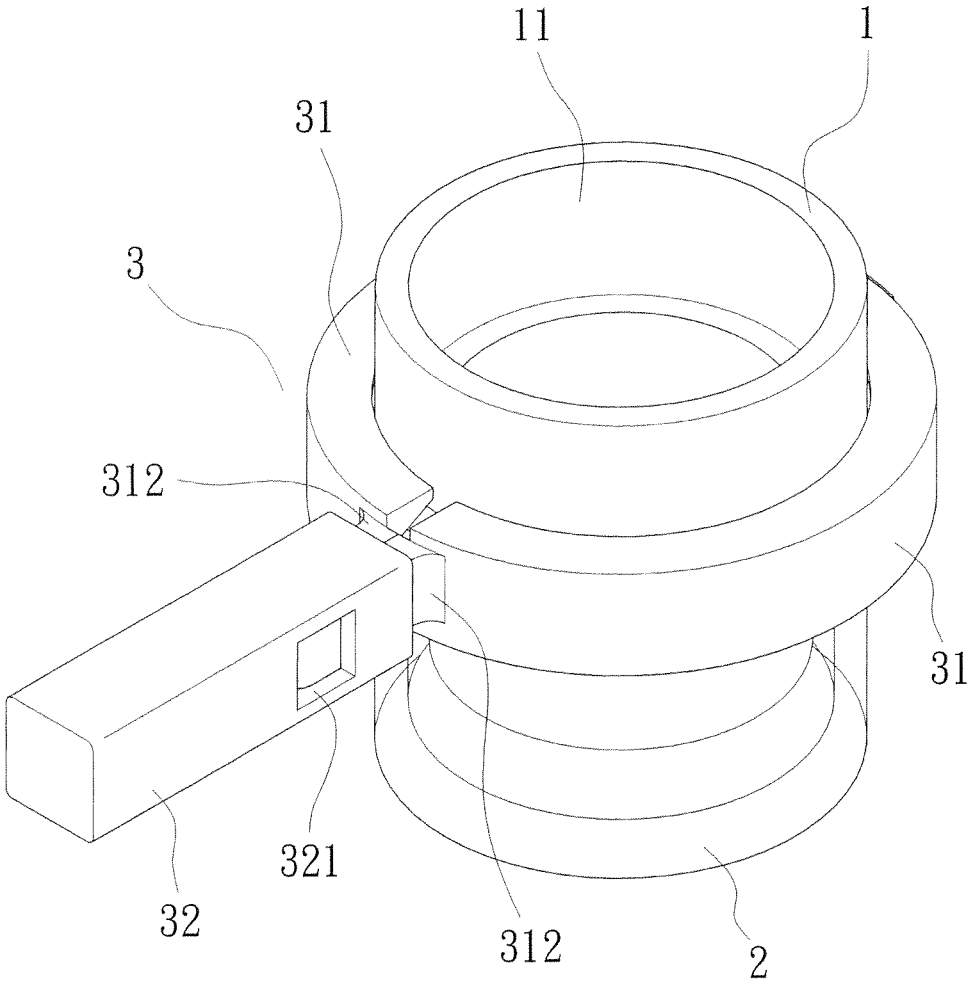
FIG. 5 shows the first status of use of the restriction member of the dual-cup assembly of the present invention.

The passage 321 is defined in the top of the restriction member 32. When the two tongues 312 are inserted into the passage 321 of the restriction member 32 to secure the first and second members 31, 31, the restriction member 32 is used as a handle as shown in FIG. 5.

Figure 6:
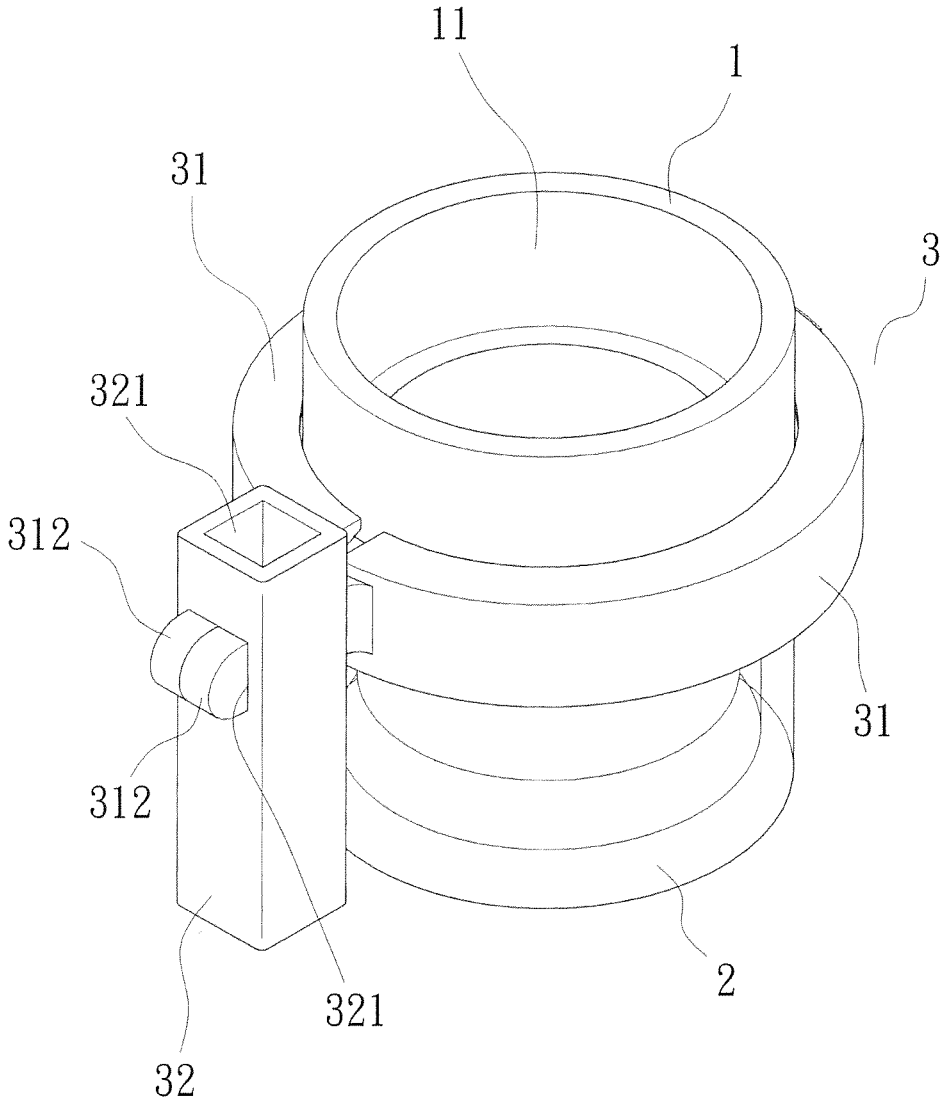
FIG. 6 shows the second status of use of the restriction member of the dual-cup assembly of the present invention.
Figure 7:
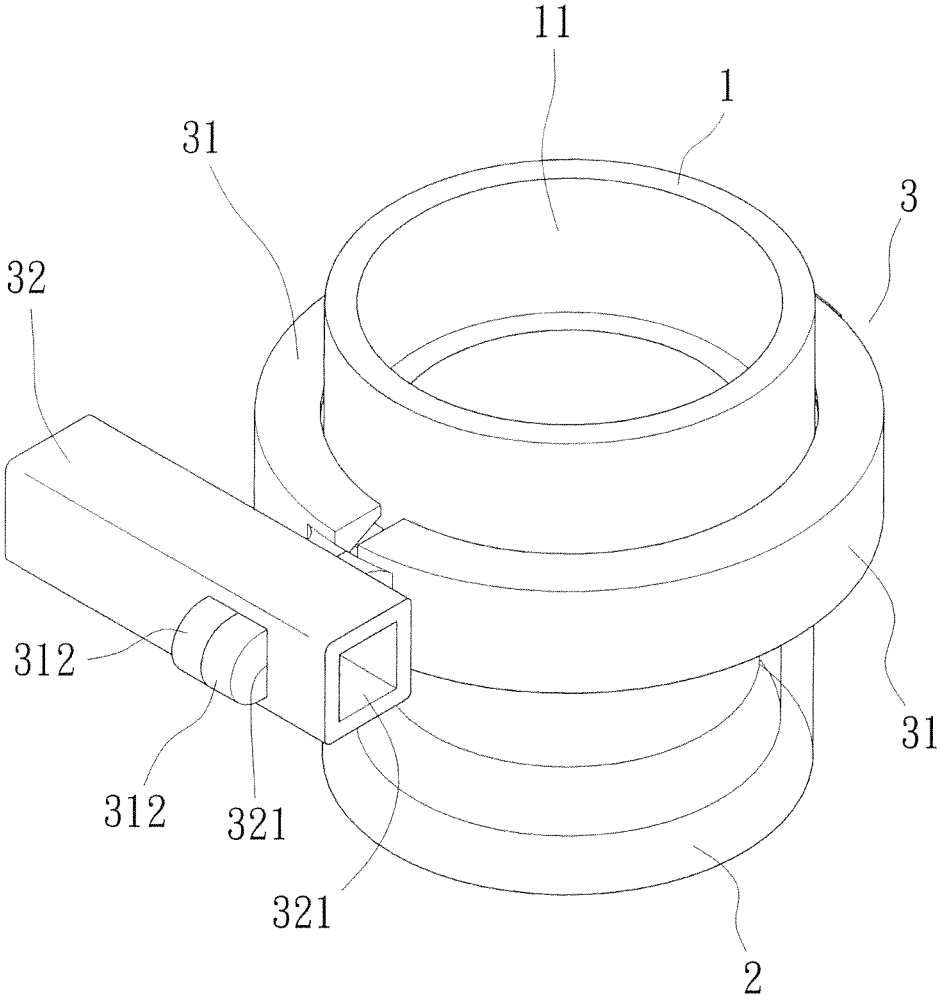
FIG. 7 shows the third status of use of the restriction member of the dual-cup assembly of the present invention.

Alternatively, the passage 321 is defined in one of sides of the restriction member 32. When the two tongues 312 are inserted into the passage 321 of the restriction member 32 to secure the first and second members 31, 31, the restriction member 32 is used as a handle as shown in FIGS. 6 and 7.

The dual-cup assembly is easily assembled by using the fastening unit 3 to secure the first and second flanges 12, 22 of the inner and outer cups 1, 2. By filling isolation material or colorful material in the room between the inner and outer cups 1, 2, the dual-cup assembly has more visual attractions and the temperature of the liquid in the inner cup is kept for a longer period of time.

While we have shown and described the embodiment in accordance with the present invention, it should be clear to those skilled in the art that further embodiments may be made without departing from the scope of the present invention.

What is claimed is:

1. A dual-cup assembly for containing liquid, comprising:

an inner cup having an open upper section for receiving said liquid and having a space defined therein, a first flange extending from an outer surface of the inner cup;

an outer cup having a reception room in which an opposing end of the open upper section of the inner cup is received, a second flange extending from an outer surface of the outer cup, said first and second flanges being mounted adjacent to each other;

a fastening unit mounted to the first flange and the second flange to connect the inner cup and the outer cup together, the fastening unit comprising a C-shaped member for clamping said inner and outer cups, said C-shaped member having a tongue extending from each of two distal ends and a restriction member defining a reconfigurable handle, the reconfigurable handle having a first passage and a second passage, the reconfigurable handle being configured into a first position when the tongues extending from the C-shaped member is inserted into the first passage and configured into a second position when the two tongues are inserted into the second passage; wherein the first position is different from the second position; and wherein the fastening unit comprises a first member and a second member, the second member is pivotably connected to the first member, each of the first member and the second member has a groove defined in an inner periphery thereof, the first and second flanges are received in the two respective grooves, each of the first and second members has said tongue extending from a distal end thereof; and the restriction member comprising a top and a side, wherein the top is perpendicular to the side, wherein the first passage is defined in the side of the restriction member and the second passage is defined in the side of the restriction member.

2. The dual-cup assembly as claimed in claim 1, wherein the C-shaped member has a groove defined in an inner periphery thereof, and the first and second flanges are received in the groove.

* * * * *